US006581254B1

(12) United States Patent
Tang

(10) Patent No.: US 6,581,254 B1
(45) Date of Patent: Jun. 24, 2003

(54) ZIPPER'S PULL HOOK STRUCTURE HAVING REPLACEABLE PULL SHEET

(76) Inventor: Ge Chian Tang, No. 2-1, Shin Beei Yuang Rd., Chun-Li, Taoyuan (TW)

( * ) Notice: Subject to any disclaimer, the term of this patent is extended or adjusted under 35 U.S.C. 154(b) by 0 days.

(21) Appl. No.: 10/000,524

(22) Filed: Dec. 4, 2001

(51) Int. Cl.[7] ..... A44B 19/26
(52) U.S. Cl. ..... 24/429; 24/419
(58) Field of Search ..... 24/429, 419, 437, 24/370, 387, 3.4, 3.12, 669; 294/3.6; 70/68

(56) References Cited

U.S. PATENT DOCUMENTS 1,215,283 A * 2/1917 Kirkland ..... 24/3.12
4,512,064 A * 4/1985 Nishikawa ..... 24/429
5,093,966 A * 3/1992 Yuki et al. ..... 24/419
5,414,903 A * 5/1995 Porteous ..... 24/3.4
5,416,951 A * 5/1995 Keyaki et al. ..... 24/429
5,875,525 A * 3/1999 Lee et al. ..... 24/429
6,035,497 A * 3/2000 Jackson ..... 24/429
6,240,604 B1 * 6/2001 Fox ..... 24/429
6,314,625 B1 * 11/2001 Ikeda ..... 24/429

* cited by examiner

*Primary Examiner*—Victor Sakran
(74) *Attorney, Agent, or Firm*—Rosenberg, Klein & Lee

(57) ABSTRACT

The present invention provides a zipper's pull hook structure having a replaceable pull sheet. The pull hook comprises a first ring portion, a second ring portion, a hook portion, and a resilient sheet portion, which are integrally formed. The first ring portion and the second ring portion are folded and stacked together. The hook portion is bent into a hook shape, and has an opening. The resilient sheet portion is situated at the opening of the hook portion. One end of the resilient sheet portion forms a free end. The opening is closed flexibly through the help of the resilient sheet portion. The hook portion can be hooked at a joint ring of a pull sheet. A zipper's pull hook having a replaceable pull sheet is thus formed.

2 Claims, 7 Drawing Sheets

ZIPPER'S PULL HOOK STRUCTURE HAVING REPLACEABLE PULL SHEET

FIELD OF THE INVENTION

The present invention relates to a zipper's pull hook structure having a replaceable pull sheet and, more particularly, to a zipper's pull hook structure capable of connecting a pull sheet and a zipper head body so that the pull sheet can be replaced flexibly.

BACKGROUND OF THE INVENTION

As shown in FIG. 1, a prior art zipper head structure comprises a zipper head body 10 and a pull sheet 11. The pull sheet 11 is connected with the zipper head body 10 by using a pull hook 12 so that the pull sheet 11 can be used to pull the zipper head for opening or closing a zipper.

The pull hook 12 has a ring portion 13 and a hook portion 14. The ring portion 13 is connected with a pivotal seat 15 at the top of the zipper head body 10. The hook portion 14 is hooked with a joint ring 16 of the pull sheet 11 so that the pull hook 12 can be connected between the zipper head body 10 and the pull sheet 11.

The above pull hook 12 is hooked at the joint ring 16 of the pull sheet 11 via the hook portion 14. The hook portion 14 is originally of panel shape. When the hook portion 14 is to be hooked at the joint ring 16 of the pull sheet 11, it is necessary to penetrate the hook portion 14 into the joint ring 16 of the pull sheet 11 and then bend the hook portion 14 into a fixed ring shape so that the ring-shaped hook portion 14 can be joined with the joint ring 16 of the pull sheet 11. After the hook portion 14 is bent into a ring shape, it will form fixed connection with the joint ring 16. It is unable to separate them so that the pull sheet 11 cannot be replaced. If the pull sheet 11 is damaged, the whole zipper head needs to be replaced.

Moreover, because the pull sheet 11 cannot be replaced, a user must use the same pull sheet 11 for a long time, lacking novelty and variability. This kind of design of the pull sheet 11 thus cannot meet the requirement of today's fashionable people.

Accordingly, the above zipper head has inconvenience and drawbacks in practical use. The present invention aims to resolve the problems in the prior art.

SUMMARY OF THE INVENTION

The primary object of the present invention is to provide a zipper's pull hook structure having a replaceable pull sheet, wherein a hook portion of the pull hook has an opening. The opening is provided with resilient closing function by a resilient sheet portion. In order to open the opening, it is only necessary to push a free end of the resilient sheet portion to swing inwards. The hook portion can thus be connected with a joint ring in mobile way, and can be separated from the joint ring so that the pull sheet can be easily replaced.

Another object of the present invention is to provide a zipper's pull hook structure having a replaceable pull sheet, whereby when the joined pull sheet is damaged, the pull sheet can be separately replaced. It is not necessary to replace the whole zipper head, hence avoiding needless waste.

Yet another object of the present invention is to provide a zipper's pull hook structure having a replaceable pull sheet, wherein the pull sheet can be replaced in mobile way. A user needs not to use the same pull sheet for a long time, and can replace a pull sheet of different shape at any time, hence having better novelty and variability and conforming to the requirement of today's fashionable people.

To achieve the above objects, the present invention provides a zipper's pull hook structure having a replaceable pull sheet. The pull hook comprises a first ring portion, a second ring portion, a hook portion, and a resilient sheet portion, which are integrally formed. The first ring portion and the second ring portion are stacked together. The hook portion is bent into a hook shape, and has an opening. The pull hook can be hooked at the pull sheet via the hook portion. The resilient sheet portion is at the opening of the hook portion. One end of the resilient sheet portion forms a free end. The opening is closed flexibly by the resilient sheet portion. A zipper's pull hook structure having a replaceable pull sheet is thus formed.

The various objects and advantages of the present invention will be more readily understood from the following detailed description when read in conjunction with the appended drawing, in which:

DETAILED DESCRIPTION OF THE PREFERRED EMBODIMENTS

Figure 1:
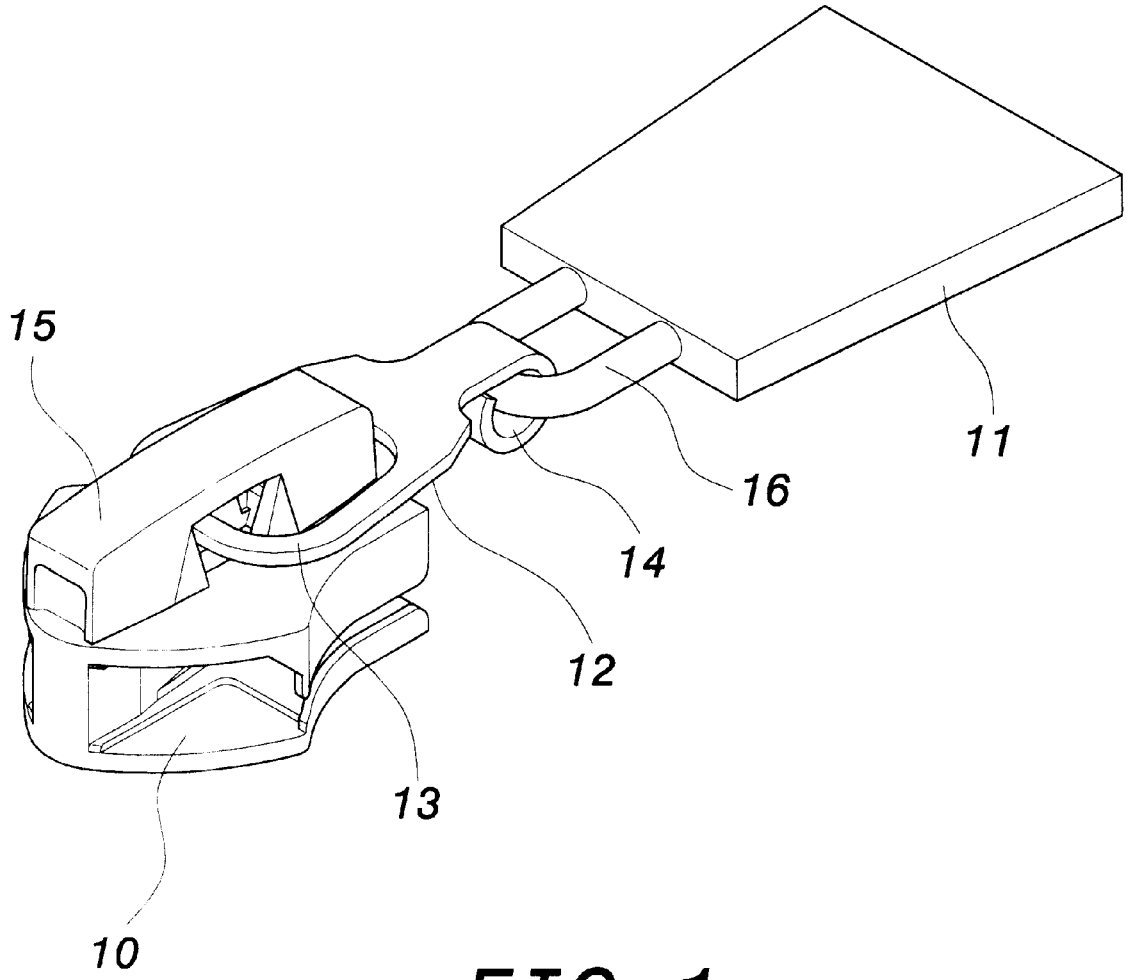
FIG. 1 PRIOR ART
FIG. 1 is a perspective view of a prior art zipper head.
Figure 2:
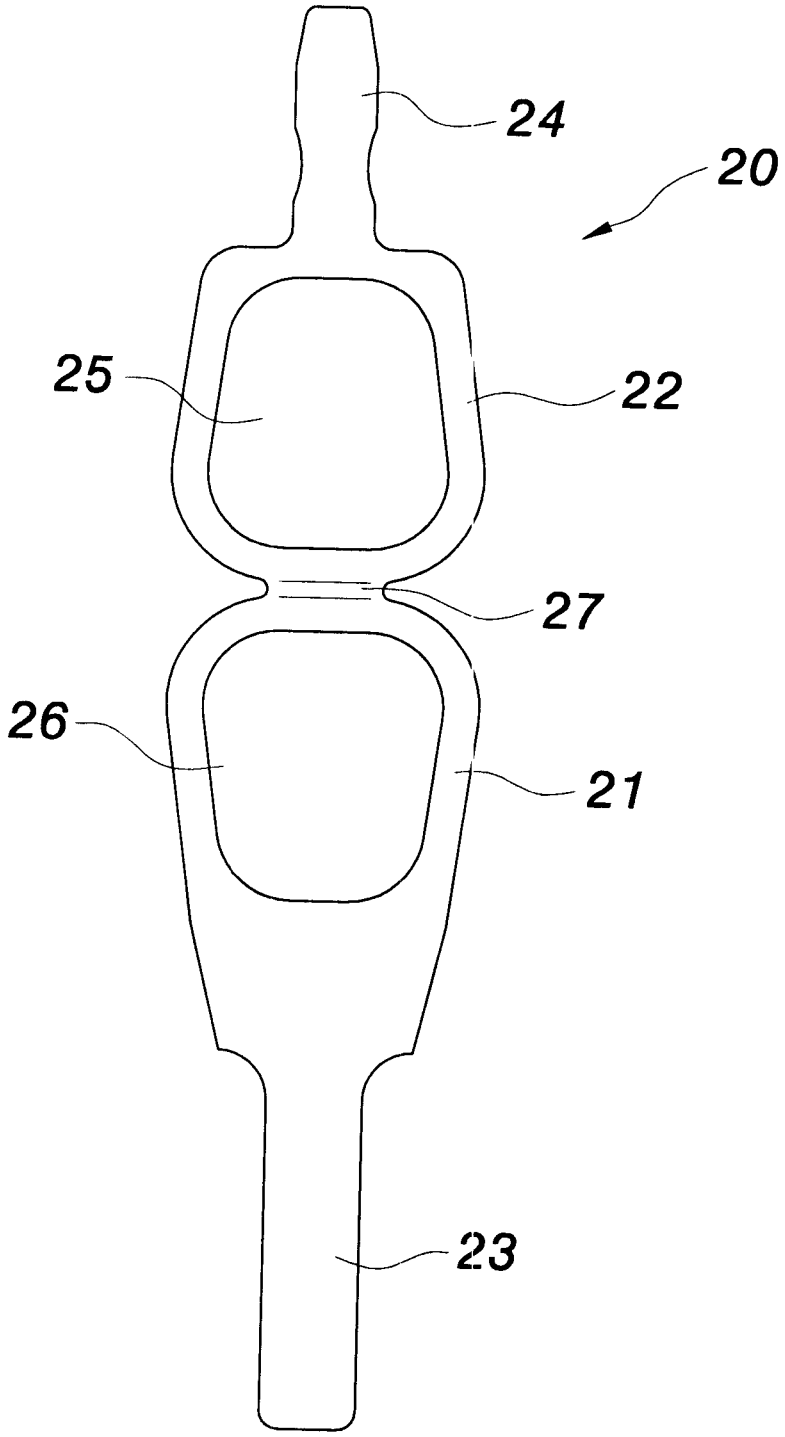
FIG. 2 is an unfolded drawing of a zipper's pull hook of the present invention.

As shown in FIG. 2, the present invention provides a zipper's pull hook structure having a replaceable pull sheet. The pull hook 20 is originally of panel shape before being bent. The pull hook 20 comprises a first ring portion 21, a second ring portion 22, a hook portion 23, and a resilient sheet portion 24, which are integrally formed. The shape of the first ring portion 21 corresponds to that of the second ring portion 22. The first and second ring portions 21 and 22 have through holes 26 and 25, respectively. The hook portion 23 and the resilient sheet portion 24 are connected to one end of the first and second ring portions 21 and 22, respectively.

Figure 3:
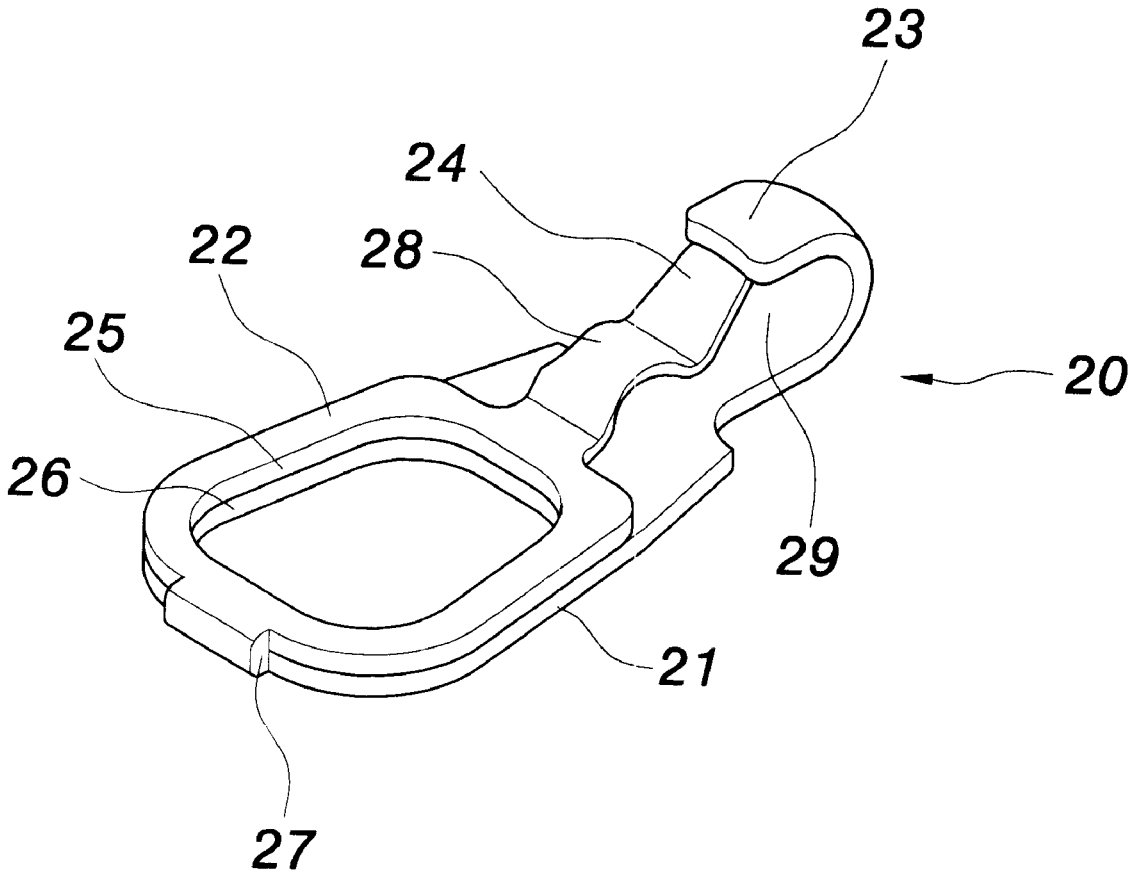
FIG. 3 is a perspective view of a zipper's pull hook of the present invention.
Figure 4:
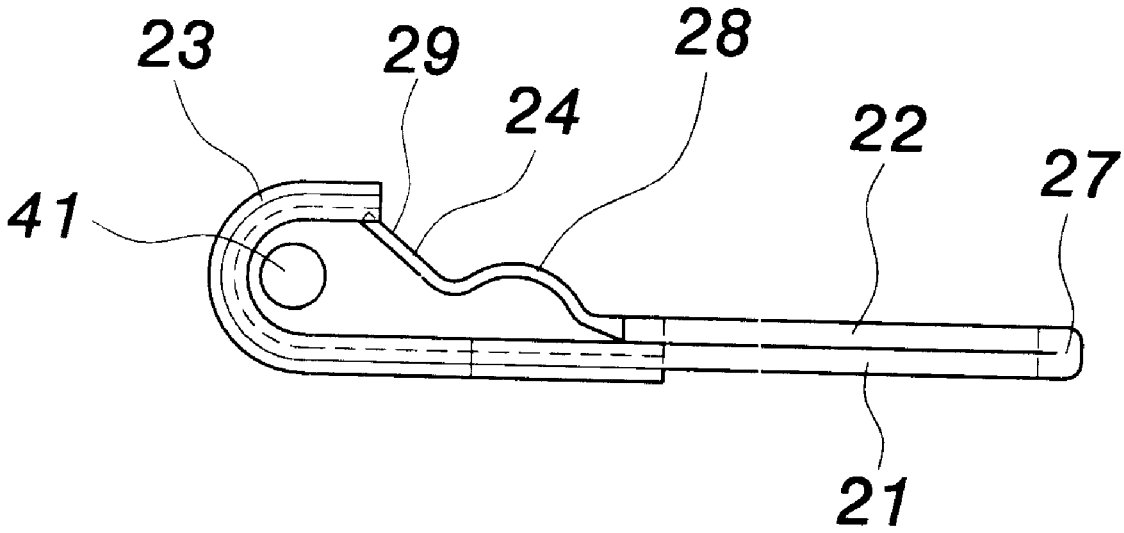
FIG. 4 is a side view of a zipper's pull hook of the present invention.
Figure 5:
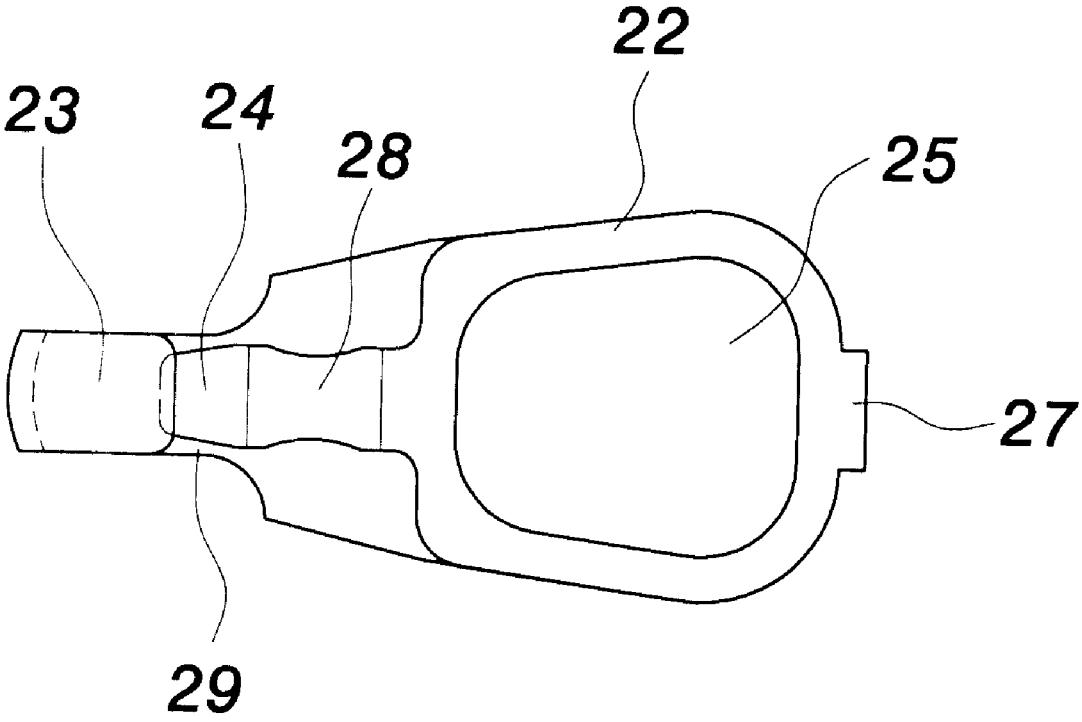
FIG. 5 is a top view of a zipper's pull hook of the present invention.

As shown in FIGS. 3, 4, and 5, a joint portion 27 is connected between the first and second ring portions 21 and 22. The first and second ring portions 21 and 22 can be folded at the joint portion 27 so that they can be stacked together. The hook portion 23 can be bent into a U-shaped hook by punching. The hook portion 23 has an opening 29. The resilient sheet portion 24 is bent to show a slanting shape, and is situated at the opening 29 of the hook portion 23. One end of the resilient sheet portion 24 forms a free end, and can abut against one end of the hook portion 23. The opening 29 is closed flexibly by the resilient sheet portion 24. The resilient sheet portion 24 can also be bent to form an arc portion 28 to increase resiliency of the resilient sheet portion 24. The cross section of the hook portion 23 can be made to form an arc shape by punching to have reinforcing function. A zipper's pull hook structure having a replaceable pull sheet of the present invention is thus formed.

Figure 6:
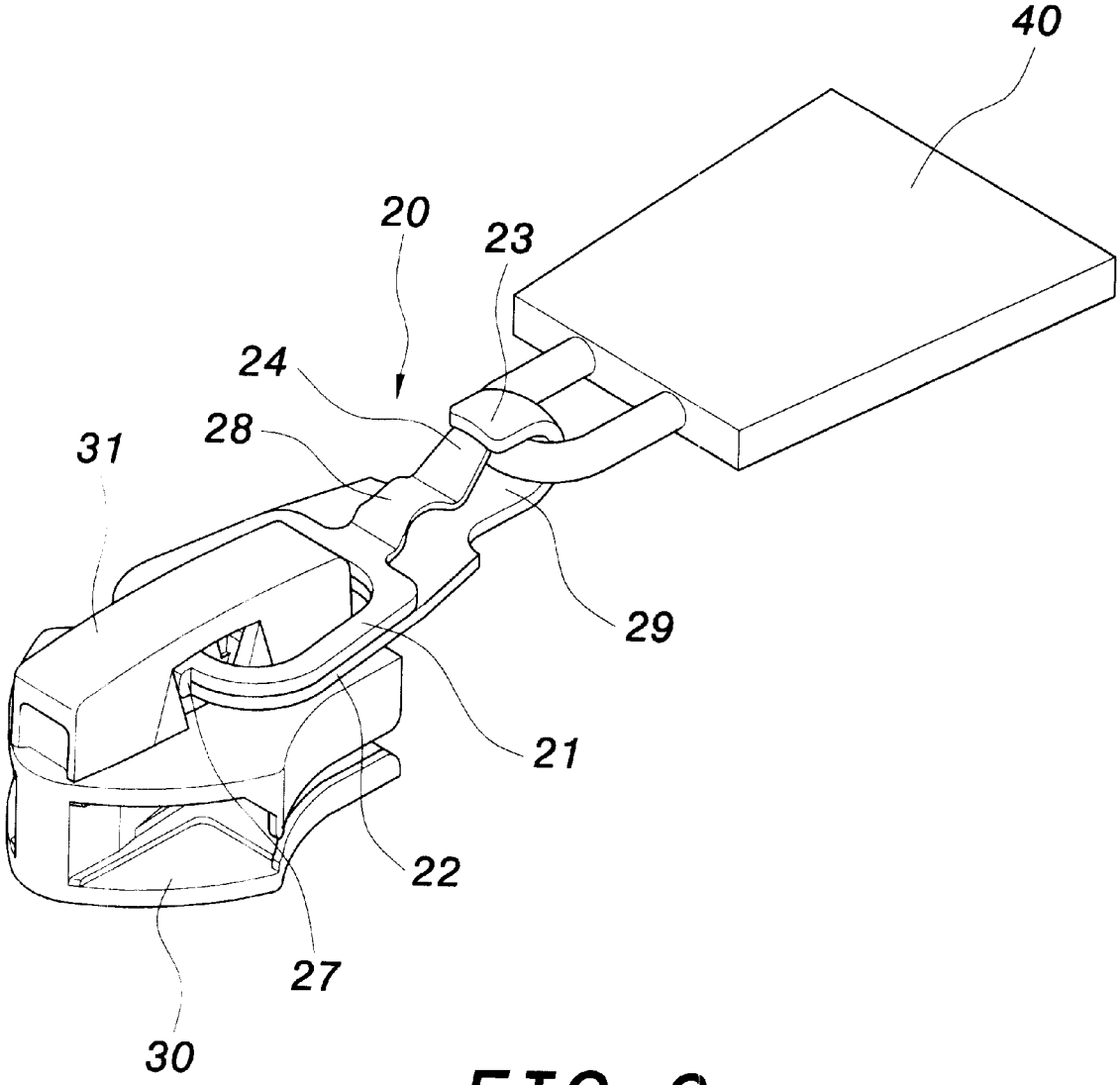
FIG. 6 is a perspective view showing the joint of a zipper's pull hook of the present invention with a pull sheet and a zipper head body.

As shown in FIG. 6, the pull hook 20 of the present invention can be connected at a pivotal seat 31 at the top of a zipper head body 30 by using the two ring portions 21 and 22. The hook portion 23 is hooked with the joint ring 41 of the pull sheet 40. The resilient sheet portion 24 can provide retaining function for the joint ring 41 to avoid the situation that the joint ring 41 leaves the hook portion 23 from the opening 29. The pull hook 20 can thus be connected between the zipper head body 30 and the pull sheet 40 so that the pull sheet 40 can be used to pull the zipper head for opening or closing a zipper.

Figure 7:
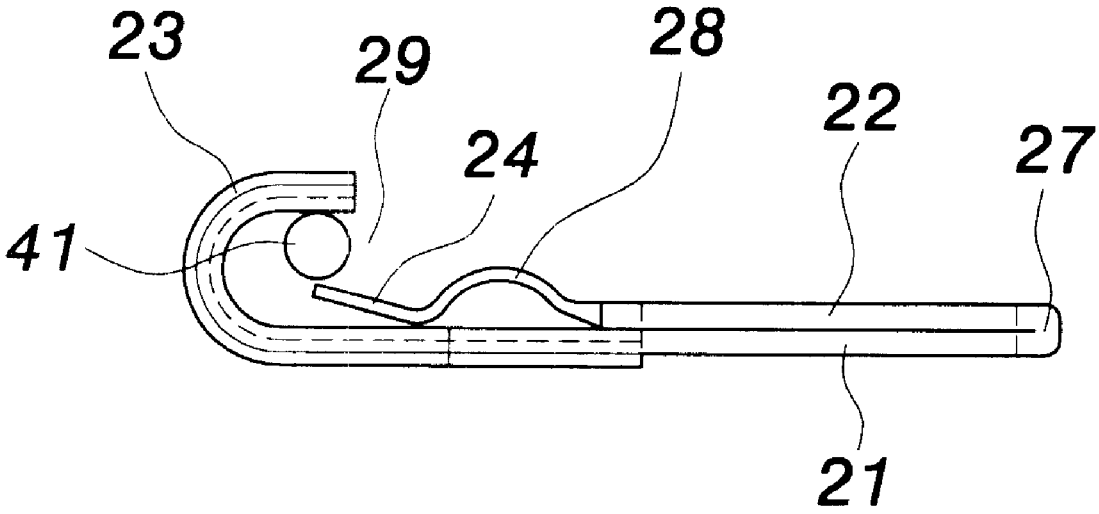
FIG. 7 is a diagram showing how a pull sheet of a zipper's pull hook of the present invention is replaced.

As shown in FIG. 7, the hook portion 23 of the pull hook 20 of the present invention has an opening 29, and the resilient sheet portion 24 provides flexible closing function for the opening 20. In order to open the opening 29, it is only necessary to push the free end of the resilient sheet portion 24 to swing inwards so that the joint ring 41 of the pull sheet 40 can leave from the hook portion 23 of the pull hook 20. Because the hook portion 23 is connected with the joint ring 41 in mobile way and can be separated from the joint ring 41 after being bent, the pull sheet 40 can be replaced. If the pull sheet 40 is damaged, it can be separately replaced. It is not necessary to replace the whole zipper head, hence avoiding needless waste.

Furthermore, the pull sheet 40 of the present invention can be replaced in mobile way. A user needs not to use the same pull sheet 40 for a long time, and can replace a pull sheet 40 of different shape at any time, hence having better novelty and variability and conforming to the requirement of today's fashionable people.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. A zipper's pull hook structure having a replaceable pull sheet, comprising a first ring portion having a first through hole formed therein, a second ring portion having a second through hole formed therein, a joint portion disposed between said first and second ring portions, a hook portion extending from said first ring portion, and a resilient sheet portion extending from said second ring portion, which are integrally formed in one-piece formation, said pull hook structure being bent at said joint portion to overlay said first and second ring portions with said first and second through holes being disposed in aligned relationship, said hook portion being bent into a hook shape, said hook portion having an opening, said resilient sheet portion having a distal end situated in said opening of said hook portion and forming a flexible releasable closure for said hook portion, a joint ring of a pull sheet being releasably engaged to said hook portion, said pull hook structure being coupled to a zipper by connection of a pivotal seat thereto through said aligned first and second through holes.

2. The zipper's pull hook structure having a replaceable pull sheet as claimed in claim 1, wherein said resilient sheet portion has an arc-shaped portion formed in an intermediate portion thereof to increase a resiliency thereof.

* * * * *